United States Patent [19]

Hanson

[11] 4,122,567

[45] Oct. 31, 1978

[54] ARTICULATED BED

[76] Inventor: Paul B. Hanson, 2761 Eastwood Dr., Decatur, Ga. 30032

[21] Appl. No.: 710,597

[22] Filed: Aug. 2, 1976

Related U.S. Application Data

[60] Continuation-in-part of Ser. No. 702,022, Jul. 2, 1976, Pat. No. 3,991,428, which is a division of Ser. No. 533,980, Dec. 18, 1974, which is a continuation of Ser. No. 406,567, Oct. 15, 1973, abandoned.

[51] Int. Cl.[2] ..... A47C 27/00

[52] U.S. Cl. ..... 5/345 R; 5/91; 5/352; 5/357; 5/327 R

[58] Field of Search ..... 5/345 R, 352, 357, 359, 5/317 R, 327 R, 341, 338, 90, 91, 355, 351

[56] References Cited

U.S. PATENT DOCUMENTS

| | | | |
|---|---|---|---|
| 254,759 | 3/1882 | Young | 5/91 |
| 801,117 | 10/1905 | Stow | 5/90 |
| 1,347,666 | 7/1920 | Amey | 5/91 |
| 1,900,474 | 3/1933 | Wilson | 5/357 |
| 2,462,579 | 2/1949 | Warner | 5/345 R |
| 2,767,410 | 10/1956 | Benson | 5/91 |
| 2,810,920 | 10/1957 | Carruth | 5/338 |
| 2,839,766 | 6/1958 | Hull | 5/338 |
| 3,083,380 | 4/1963 | Adler | 5/345 R |
| 3,513,491 | 5/1970 | Gordon | 5/357 |
| 3,742,528 | 7/1973 | Munch | 5/91 |

*Primary Examiner*—Kenneth J. Dorner

*Attorney, Agent, or Firm*—Newton, Hopkins & Ormsby

[57] ABSTRACT

An improved articulated bed having a main mattress support, a main mattress on the top of the support and having a cavity in which an auxiliary mattress is removably positioned, the auxiliary mattress having a pair of slots formed in its upper surface sized to receive human knees and padding material aggregately sized to occupy the slots. Another embodiment comprises the mattress support having a cavity in alignment with the main mattress cavity and in which an auxiliary mattress support is removably positioned. Heel support depressions are provided on the top surface of the mattress along with heel supporting inserts for the depressions to provide support for the user's heels in a variety of positions. Reinforcing means is provided within the mattress adjacent the mattress cavity. The mattress is secured to the support by means of snaps or projections in the support which engage the bottom surface of the mattress.

12 Claims, 11 Drawing Figures

ARTICULATED BED

CROSS-REFERENCE TO RELATED APPLICATIONS

This is a continuation-in-part of application Ser. No. 702,022, filed July 2, 1976; now U.S. Pat. No. 3,991,428 which is a division of application Ser. No. 533,980, filed Dec. 18, 1974, entitled "Articulated Bed", which was a continuation of application Ser. No. 406,567, filed Oct. 15, 1973 and now abandoned.

BACKGROUND OF THE INVENTION

This invention relates generally to articulated beds, and, in particular, to articulated beds of the type which may be adjusted to facilitate sexual intercourse between two people supported upon the bed.

Accordingly, it is a general object of the present invention to provide an improved articulated bed.

More specifically, it is an object of the present invention to provide an articulated bed having a plurality of components, the relative heights of which may be adjusted to facilitate sexual intercourse betweeen two people in a plurality of positions supported upon the bed.

SUMMARY OF THE INVENTION

In one form of the invention, an articulated bed is provided comprising a main mattress having a U-shaped cavity along one of its ends in which an auxiliary mattress is removably positioned with its upper surface coplanar with that of the main mattress. The auxiliary mattress has a pair of spaced slots longitudinally formed in its upper surface and being sized to receive human knees. Padding material is sized to occupy the slots, the material being unitary in one embodiment and comprised of an aggregate of pads in another embodiment.

Another form of the present invention comprises a main mattress support with a U-shaped cavity centrally disposed through one of its ends, support means removably received within the cavity, a main mattress on the upper surface of the mattress support and having a U-shaped cavity in registry with the cavity in the support, and removable mattress means received within the mattress cavity, the support means and the mattress means being selectively removable to facilitate the use of the main mattress for sexual intercourse. The support means comprises a plurality of pads stacked one on the other.

A pair of depressions are provided in the top of the main mattress adjacent the sides of the mattress cavity, the depressions dimensioned to receive the heels of a person lying on the main mattress. Inlays are provided for the depressions to selectively maintain a smooth top surface for the main mattress. Additionally, inserts may be provided for the depressions which are shaped to provide support for the heels of the user in a variety of positions upon the surface of the mattress.

The sides of the main mattress cavity are reinforced by means of a U-shaped support member centrally maintained within the main mattress and having top and bottom sets of coiled springs connected thereto.

A further embodiment of the present invention includes the main mattress being constructed of foam rubber with a support member imbedded within the mattress adjacent the sides of the cavity.

The mattress may be secured to prevent lateral movement of the mattress on the support by means of flaps mounted on the support which snap-fittingly engage the mattress. Another modification is to have upstanding elements mounted to the bottom of the support which project upwardly above the top surface of the support to engage grooves within the bottom surface of the mattress.

DESCRIPTION OF THE PREFERRED EMBODIMENTS

Figure 1:
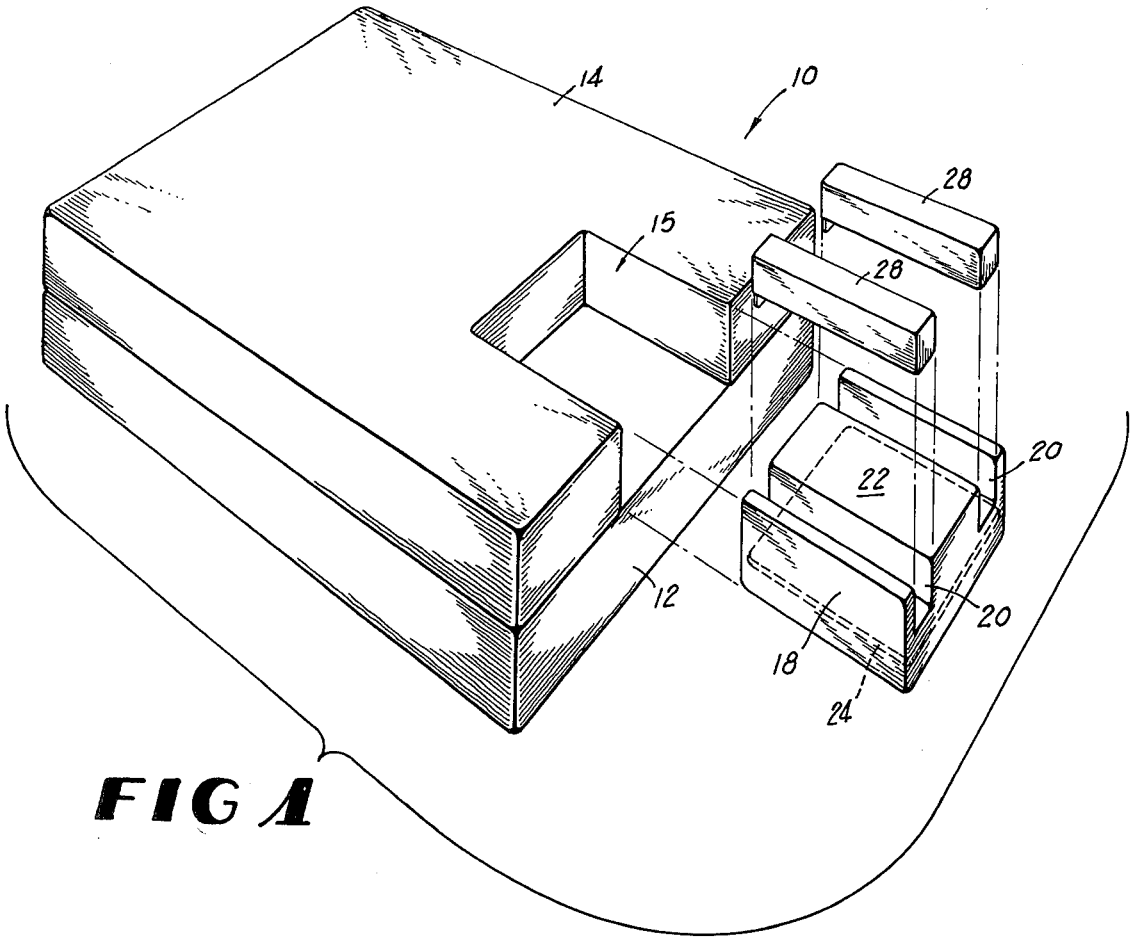
FIG. 1 is an exploded perspective view of the first embodiment of the improved articulated bed of the present invention.

Referring now in more detail to the drawings, there is shown in FIG. 1 an improved articulated bed 10 embodying principles of the present invention in one preferred form. The bed 10 includes a rectangular lower support 12, such as a set of boxed springs, atop which is set a main mattress 14. This mattress 14 is of the same rectangular shape and size as that of the lower support 12 except that the mattress 14 is provided with a U-shaped recess or cavity 15 centrally disposed in an end thereof.

The bed 10 is further provided with an auxiliary mattress 18 of a size and shape to substantially fill the main mattress cavity 15. Thus, when auxiliary mattress 18 is positioned within the cavity 15 with both mattresses 14, 18 resting upon the top flat surface of the lower support 12, the upper surfaces of both mattresses 14, 18 are substantially coplanar.

Figure 2:
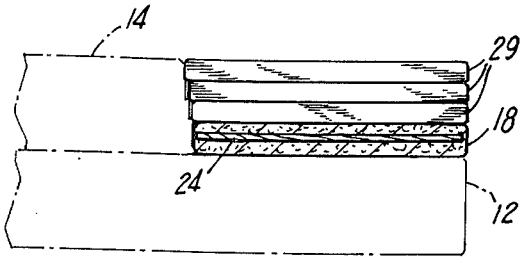
FIG. 2 is a cross-sectional side view in elevation of the auxiliary mattress component of the improved articulated bed shown in FIG. 1 with pads seated therein of sizes different from those of the pads shown in FIG. 1.
Figure 3:
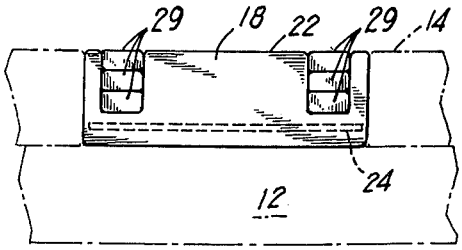
FIG. 3 is a front view in elevation of the auxiliary mattress and pads shown in FIG. 2.
Figure 4:
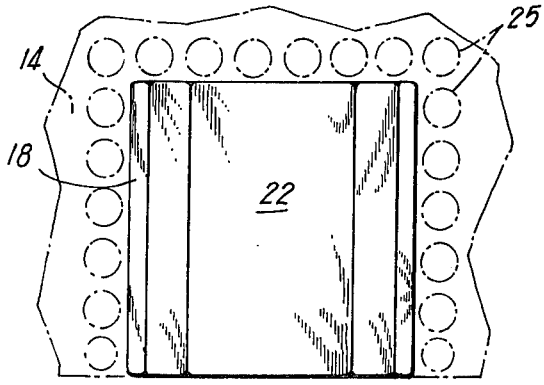
FIG. 4 is a top plan view of an end portion of the improved articulated bed shown in FIG. 1.

The auxiliary mattress 18 itself is provided with two rectangular slots 20 longitudinally extending through the top surface. The width of slots 20 is such as to snugly accommodate the knees of a human being kneeling therein. An upstanding bridge portion 22 of the auxiliary mattress 18 that separates the slots 20 is of a width to enable a human easily to straddle the bridge 22 with knees positioned within the slots 20 and gain added support therefrom. A rigid, rectangular support 24 is horizontally embedded in the auxiliary mattress 18 beneath the slots 20 for further support while a set of coiled springs 25 line the periphery of the main mattress 14 about cavity 15 for added firmness. In FIG. 1, the auxiliary mattress 18 is seen to include a pair of pads 28 sized to substantially occupy slots 20 when removably set therein. In FIGS. 2 and 3, a set of three pads 29 are provided to substantially occupy each slot 20.

In use, the auxiliary mattress 18 may be completely removed from atop support 12 and out of cavity 15. A couple may then engage in front-to-front positional sexual intercourse with the female reclining on main mattress 14 with her legs straddling the cavity 15, while her male partner is positioned through cavity 15 with his knees upon the top of support 12. Alternatively, the auxiliary mattress 18 may be placed in cavity 15 with the slots 20 filled with only certain of pads 29 to, thus, selectively elevate the male. A couple may then engage in front to rear positional sexual intercourse with the female kneeling on the main mattress 14 and the male kneeling on the padding material in slots 20.

When the bed is to be used for resting and sleeping, the slots 20 may be completely filled with padding material, such as pads 28, to render the entire upper surface of the bed flat. Also, the auxiliary mattress 18 may be turned over 180° and set within cavity 15 such that the bottom surface of mattress 18 is coplanar with the top surface of mattress 14.

Figure 5:
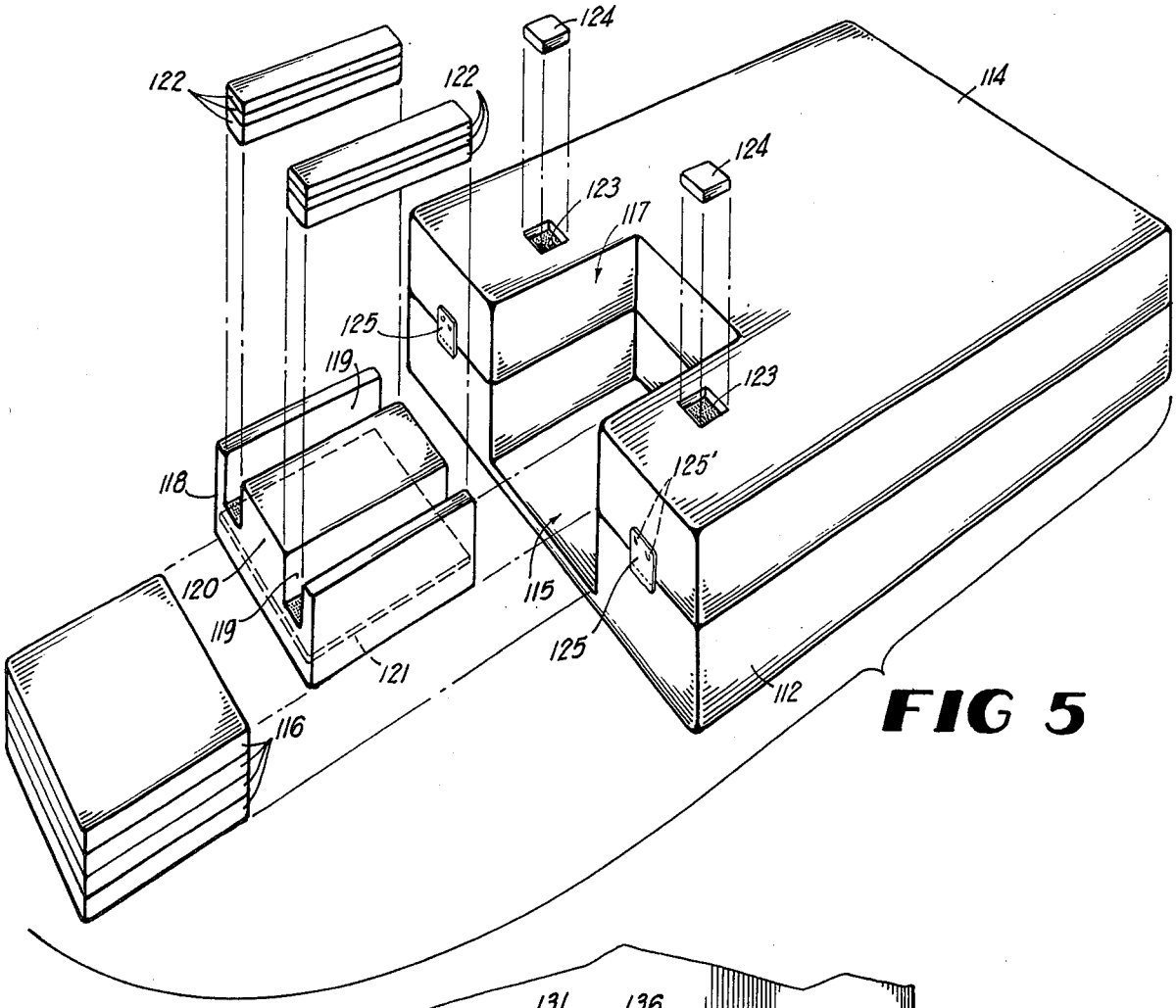
FIG. 5 is an exploded perspective view of the second embodiment of the present invention.

FIG. 5 illustrates another embodiment of the improved articulated bed and is referred to generally by the numeral 100. Bed 100 comprises a main mattress support 112 and a main mattress 114.

The main mattress support 112 is rectangular in shape and has partially disposed through one of its ends a U-shaped cavity 115. Removable support means is slidably received within cavity 115 and comprises a plurality of pads 116. When all of pads 116 are placed within cavity 115, the top surface of the uppermost pad 116 is substantially coplanar with the top surface of support 112.

Centrally disposed through an end of mattress 114 is a rectangular cavity 117 which is of the same dimensions as cavity 115, such that cavities 115, 117 are in registry. An auxiliary mattress 118 is of a size and shape to substantially fill the mattress cavity 117 and is provided with two rectangular slots 119 longitudinally extending through its top surface. An upstanding bridge portion 120 separates the slots 119. As with the above described slots 20, slots 119 are of a dimension to accommodate the knees of a human being who straddles bridge 120. A rigid, rectangular support element 121 is positioned within mattress 118 below slots 119. A set of removable mattress inserts comprising a set of three pads 122 stacked one on top of the other are dimensioned to be slidably received and to substantially occupy each slot 119.

The top surface of mattress 114 is provided with a pair of depressions 123 which are aligned adjacent the sides of cavity 117. Inlays 124 are each dimensioned to be slidably received within the depressions 123. With the inlays 124 within depressions 123, the top surface of mattress 114 is substantially continuous.

To prevent lateral movement of the mattress 114 on the support 112, flexible flaps 125 are secured to support 112 along one side adjacent its top surface by any suitable means, such as stitching, to engage snaps 125' provided on mattress 114.

The mattress 114 can be utilized for normal sleeping activity by placing all of the removable sections of mattress 14 and support 112 in their respective places, namely, with all of the pads 116 in place within cavity 115, auxiliary mattress 118 in place within cavity 117 and being supported on the top surface of the uppermost pad 116, all of the pads 122 in place within slots 119, and with inlays 124 in place within depressions 123.

Figure 10:
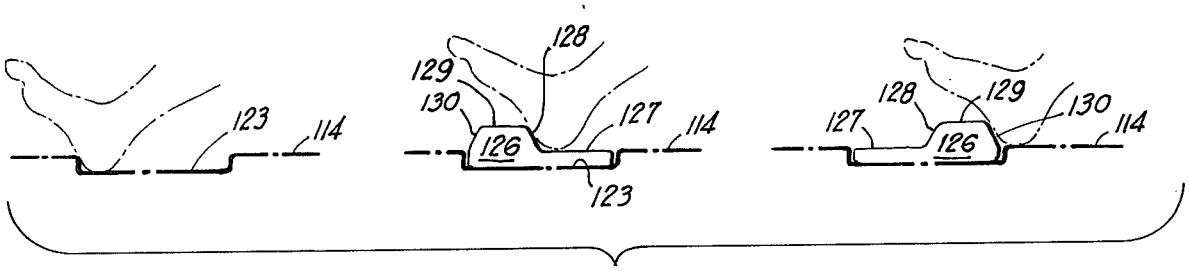
FIG. 10 is comprised of side elevational views of the mattress depression of the present invention with two of the views including an insert therein.

When it is desired to utilize bed 100 for sexual intercourse, the inlays 124 can be removed from the depressions 123 so as to receive the heels of the women partner who lies upon the top surface of mattress 114 as shown in the left-hand view of FIG. 10. The utilization of pads 116 and auxiliary mattress 118 depends upon the height which the male partner wishes to select. With all of the pads 116 in place within cavity 115, and auxiliary mattress 118 supported within cavity 17 on the top surface of the uppermost pad 116, the male can place his knees within slots 119 and be elevated at a height which is determined by the number of inserts 122 which are utilized within slots 119. As pads 116 are selectively removed from top one another, the height of auxiliary mattress 118 is correspondingly lowered such that the lowermost portion of the mattress 118 enters the cavity 115.

The position of the female partner on top of mattress 114 may be further facilitated by means of heel supporting elements 126 which are of dimensions to be received within depressions 123. The top surface of element 126 is articulated and includes a horizontally disposed portion 127 which terminates in an upwardly inclined surface 128 which rises to horizontal top 129 which terminates in a downwardly sloped surface 130. As shown in the middle view off FIG. 10, the element 126 can be positioned within depression 123 such that the heel portion of the woman's foot can engage surface 127 and inclined surface 128. In the far right view of FIG. 10, the element 126 is — shown to be rotated 180° from the middle view of FIG. 10 such that the heel portion of the woman's foot rests on the top surface of mattress 114 and engages surface 130.

Figure 6:
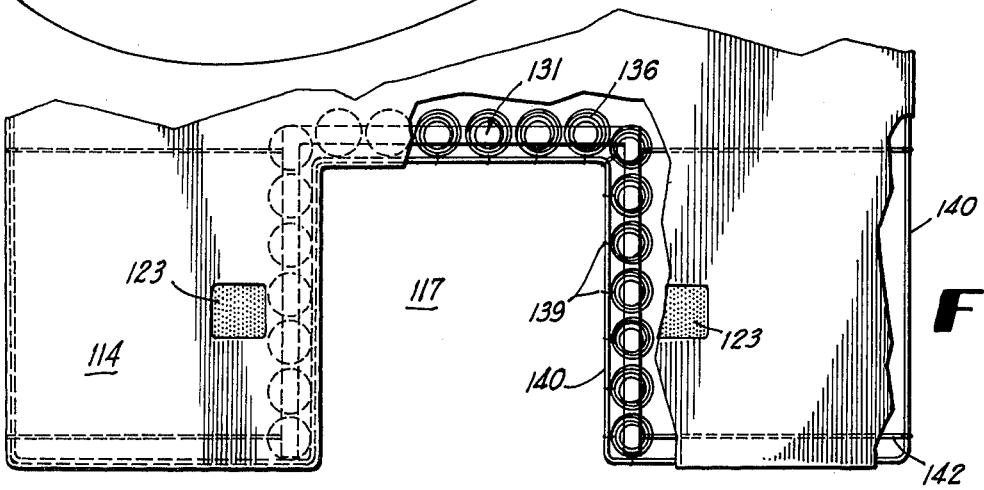
FIG. 6 is a top plan view of a portion of the second embodiment with portions cut-away for clarity.
Figure 7:
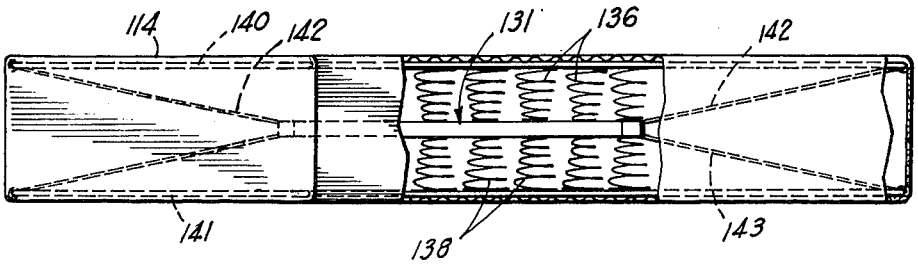
FIG. 7 is an end elevational view of the mattress shown in FIG. 6.
Figure 8:
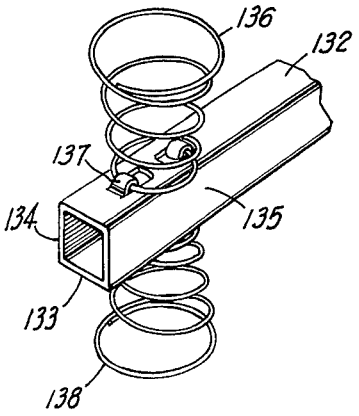
FIG. 8 is a perspective view of a portion of the cavity reinforcing means construction.

Referring to FIGS. 6 – 7, it can be seen that a reinforcing means is provided mattress 114 to maintain its vertical and lateral integrity without sagging adjacent cavity 117. The reinforcing means includes a U-shaped, square tubing member 131 having horizontal top and bottom surfaces 132, 133, and vertical side walls 134, 135. Member 131 is horizontally and centrally disposed within mattress 114 adjacent the sides of cavity 117. A plurality of coiled springs 136 are mounted along top surfce 132 by means of tabs 137 which are formed from the top surface 132 and folded over the lowermost coil of springs 136. Another set of springs 138 are likewise secured to bottom surface 133. As shown in FIG. 6, the springs 136 are prevented from lateral movement by means of hooks 139 which engage top perimeter wire 140 which extends below the top surface of mattress 114 adjacent its upper edges; the lower set of springs 138 likewise engages a lower perimeter wire 141 which extends adjacent the inner periphery of mattress 114 by means of hooks which are not shown. The element 131 is secured to wires 140, 141 by means of upper and lower restraining wires 142, 143.

Figure 9:
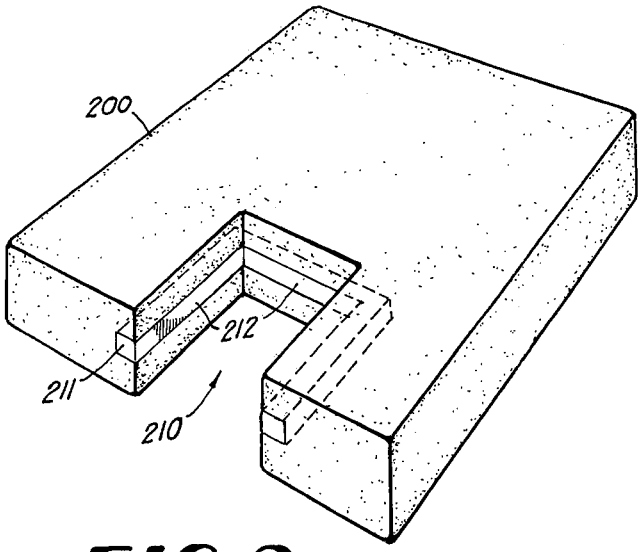
FIG. 9 is a perspective view of another form of the mattress of the present invention.

FIG. 9 shows a further embodiment of the mattress portion of the present invention and includes a mattress 200 having a rectangular recess or cavity 210 provided through one of its ends. The mattress 200 is composed of foam-like material and has a unitary support member 211 centrally disposed or embedded within the mattress 200 with its inner edges 212 visible within cavity 210. The member 211 functions as a means for reinforcing the mattress 200 adjacent the sides of cavity 210.

Figure 11:
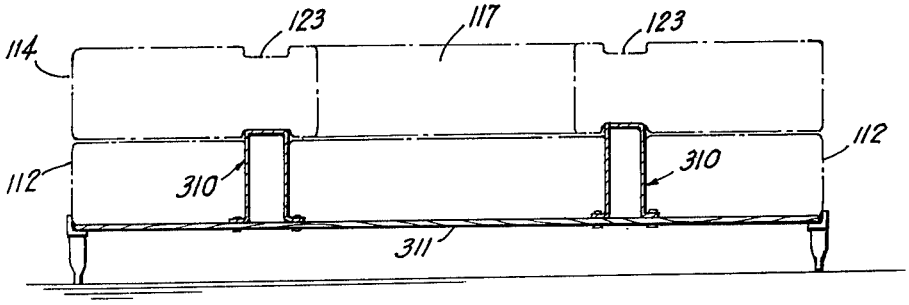
FIG. 11 is a cross-sectional end elevational view of the mattress securing means with the support and the mattress shown in phantom lines.

FIG. 11 shows another means for restraining the lateral movement of mattress 114 while it rests on the top surface of support 112. The restraining means includes a pair of upstanding elements 310 which are secured to rigid bottom 311 of support 112 by any suitable means such as bolts. Bottom 211 can be constructed of wood.

The elements 310 are positioned below depressions 123 and project above the top surface of support 112 to engage suitably dimensioned grooves within the bottom surface of mattress 114.

What I claim is:

1. An improved articulated bed, comprising:

(a) a main mattress support having flat top and bottom surfaces and a first cavity disposed in one of its ends;

(b) a main mattress on said top surface and having a second cavity disposed along one of its ends in registry with said first cavity;

(c) removable support means within the first cavity;

(d) removable mattress means within said second cavity and being supported on said removable support means, said support means and said mattress means being selectively removable from said respective cavities to facilitate use of said main mattress and said cavities for sexual intercourse; said removable support means includes a plurality of pads stacked one on the other.

2. An improved articulated bed, comprising:

(a) a main mattress support having flat top and bottom surfaces and a first cavity disposed in one of its ends;

(b) a main mattress on said top surface and having a second cavity disposed along one of its ends in registry with said first cavity;

(c) removable support means within said first cavity;

(d) removable mattress means within said second cavity and being supported on said removable support means, said support means and said mattress means being selectively removable from said respective cavities to facilitate use of said main mattress and said cavities for sexual intercourse, said removable mattress means having a pair of spaced recesses longitudinally disposed through its top surface; and (e) mattress means inserts removably received within said recesses, said inserts each comprise a plurality of pads stacked one on the other.

3. An improved articulated bed, comprising:

(a) a main mattress support having flat top and bottom surfaces and a first cavity disposed in one of its ends;

(b) a main mattress on said top surface and having a second cavity disposed along one of its ends in registry with said first cavity;

(c) removable support means within said first cavity;

(d) removable mattress means within said second cavity and being supported on said removable support means, said support means and said mattress means being selectively removable from said respective cavities to facilitate use of said main mattress and said cavities for sexual intercourse; and (e) said mattress support including means for reinforcing said support adjacent said first cavity, said reinforcing means comprising a spring support member centrally disposed within said mattress support adjacent the inner edges of said first cavity, wires extending within said support adjacent its upper and lower perimeters, springs attached about one of their ends along the top and bottom of said spring support member and being further connected to said upper and lower wires adjacent the other ends of said springs.

4. An improved articulated bed, comprising:

(a) a main mattress support having flat top and bottom surfaces and a first cavity disposed in one of its ends;

(b) a main mattress on said top surface and having a second cavity disposed along one of its ends in registry with said first cavity;

(c) removable support means within said first cavity;

(d) removable mattress means within said second cavity and being supported on said removable support means, said support means and said mattress means being selectively removable from said respective cavities to facilitate use of said main mattress and said cavities for sexual intercourse, said main mattress being provided with a pair of depressions aligned in its top surface adjacent the sides of said second cavity; and (e) heei supporting elements removably received within said depressions, the top surface of each of said elements comprising a first horizontal portion, a second horizontal portion which is at a higher elevation than said first horizontal portion, and an inclined portion interconnecting said first and second horizontal portions.

5. An improved articulated bed as claimed in claim 4, wherein said second horizontal portion terminates in a downwardly inclined portion.

6. An improved articulated bed, comprising:

(a) a main mattress support having a flat top and bottom surfaces;

(b) a main mattress on said top surface and having a cavity disposed on one of its ends; said cavity opening toward said one of said ends;

(c) a removable support means received within and filling said cavity, said removable support means being provided with a pair of spaced longitudinally extending recesses extending throughout the length of said removable support means; and (d) mattress means inserts removably received within and filling said recesses, the upper surfaces of said main mattress, said removable mattress means and said inserts being disposed in a common plane.

7. The improved articulated bed as claimed in claim 6 wherein said cavity is rectangular in shape and said removable mattress means is rectangular in shape and wherein said recesses are disposed parallel to each other and are spaced inwardly of the edges of said removable mattress means, said removable mattress means substantially filling said cavity.

8. An improved articulated bed, comprising:

(a) a main mattress support having flat top and bottom surfaces and a first cavity disposed in one of its ends, said cavity being open toward said one of said ends;

(b) a main mattress on said top surface and having a second cavity disposed along one of its ends in vertical alignment with said first cavity; and second cavity being open toward said one of said ends of said main mattress;

(c) removable support means within said first cavity;

(d) removable mattress means within said second cavity and being supported on said removable support means and being selectively removable from their respective cavities to facilitate use of said main mattress and said cavities for sexual intercourse, said removable mattress means having an upper surface parallel to said top surface of said main mattress and a pair of spaced recesses longitudinally disposed in said upper surface.

9. An improved articulated bed as claimed in claim 8 including mattress means inserts removably received within and filling said recesses.

10. An improved articulated bed, comprising:

(a) a main mattress support having flat top and bottom surfaces and a first cavity disposed in one of its ends, said cavity being open toward said one of said ends;

(b) a main mattress on said top surface and having a second cavity disposed along one of its ends in vertical alignment with said first cavity; said second cavity being open toward said one of said ends of said main mattress;

(c) removable support means within said first cavity;

(d) removable mattress means within said second cavity and being supported on said removable support means and being selectively removable from their respective cavities to facilitate use of said main mattress and said cavities for sexual intercourse, said main mattress including a pair of depressions along its top surface adjacent the sides of said second cavity.

11. An improved articulated bed as claimed in claim 10 wherein said main mattress further includes a pair of inlays each removably positioned within said depressions.

12. An improved articulated bed comprising:

(a) a main mattress support having flat top and bottom surfaces and a first cavity disposed in one of its ends, said cavity being open toward said one of said ends;

(b) a main mattress on said top surface and having a second cavity disposed along one of its ends in vertical alignment with said first cavity; said second cavity being open toward said one of said ends of said main mattress;

(c) removable support means within said first cavity;

(d) removable mattress means within said second cavity and being supported on said removable support means being selectively removable from their respective cavities to facilitate use of said main mattress and said cavities for sexual intercourse;

(e) said first and second cavities being and respectively defined by U-shaped portions of said main mattress support and said mattress and being of approximately the same dimensions, said removable mattress means and said removable support means being rectangular and filling said cavities; and (f) said main mattress being constructed of foam-like material and including means for reinforcing said mattress adjacent said cavity, said reinforcing means comprising a unitary, U-shaped element horizontally and centrally embedded within said mattress adjacent the sides of said cavity.

* * * * *